US009549642B2

(12) United States Patent
Kim

(10) Patent No.: US 9,549,642 B2
(45) Date of Patent: Jan. 24, 2017

(54) BIDET FOR INFANTS AND CHILDREN

(71) Applicant: Ju Jin Kim, Hanam-si (KR)

(72) Inventor: Ju Jin Kim, Hanam-si (KR)

( * ) Notice: Subject to any disclaimer, the term of this patent is extended or adjusted under 35 U.S.C. 154(b) by 0 days.

(21) Appl. No.: 14/894,024

(22) PCT Filed: May 16, 2014

(86) PCT No.: PCT/KR2014/004416

§ 371 (c)(1),
(2) Date: Nov. 25, 2015

(87) PCT Pub. No.: WO2014/193108

PCT Pub. Date: Dec. 4, 2014

(65) Prior Publication Data

US 2016/0106268 A1 Apr. 21, 2016

(30) Foreign Application Priority Data

May 30, 2013 (KR) ..... 10-2013-0062014

(51) Int. Cl.

| | |
|---|---|
| ***A47K 3/022*** | (2006.01) |
| ***A47K 3/26*** | (2006.01) |
| ***A47K 3/12*** | (2006.01) |
| ***A47K 3/024*** | (2006.01) |

(52) U.S. Cl.

CPC ..... *A47K 3/26* (2013.01); *A47K 3/024* (2013.01); *A47K 3/127* (2013.01)

(58) Field of Classification Search

CPC ..... A47K 3/26

USPC ..... 4/443–448

See application file for complete search history.

(56) References Cited

U.S. PATENT DOCUMENTS 4,216,552 A 8/1980 Gurolnick

FOREIGN PATENT DOCUMENTS

| | | |
|---|---|---|
| KR | 20-2000-0019866 U | 11/2000 |
| KR | 20-0441036 Y1 | 7/2008 |
| KR | 20-2012-0000742 U | 2/2012 |

OTHER PUBLICATIONS

International Search Report of PCT/KR2014/004416 dated Sep. 30, 2014.

*Primary Examiner* — Lori Baker
(74) *Attorney, Agent, or Firm* — Sughrue Mion, PLLC

(57) ABSTRACT

A bidet for infants and children includes a main body that is shaped as a chair, has an inner surface and an outer surface and comprises a backrest part with a predetermined length, a cradling part forming a predetermined angle with the backrest part, and a buttock-cradling part between the backrest part and the cradling part and connecting the backrest part and the cradling part and concavely recessed in the inner surface of the main body, a plurality of hang protrusions formed at an outer surface of the backrest part and arranged with predetermined intervals for fixing the main body at different angles, and a supporting member having a predetermined length and formed at a bottom surface of the buttock-cradling part, and a discharge port is formed lengthwise through a center portion of the buttock-cradling part concavely recessed in the inner surface of the main body.

8 Claims, 7 Drawing Sheets

BIDET FOR INFANTS AND CHILDREN

CROSS REFERENCE TO RELATED APPLICATIONS

This is a National Stage of International Application No. PCT/KR2014/004416 filed May 16, 2014, claiming priority based on Korean Patent Application No. 10-2013-0062014 filed May 30, 2013, the contents of all of which are incorporated herein by reference in their entirety.

TECHNICAL FIELD

The inventive concept relates to a bidet for infants and children, and more particularly, to a bidet for infants and children for conveniently cleaning children's buttocks.

BACKGROUND ART

Generally, infants and children have to bathe often because they frequently urinate and defecate and have low level of immunity compared to adults. In particular, since children urinate and defecate while wearing diapers, children's buttocks may be infected with urine and feces, which may harmful for the children's health.

In order to bathe a child such as a infant that cannot balance by oneself, the child's back and neck have to be covered with one hand and use the other hand to clean the child. In this case, the child may be dropped by mistake. Accordingly, bathing a child with only one hand is not convenient.

In order to solve the problem above, an apparatus for sitting a child and easily bathing the child using both hands is needed. KR 20-0178060 (hereinafter, referred to as 'cited invention') discloses a chair for bathing infants.

FIG. 1 of the cited invention shows that two bathing chair legs 26 extend at both sides, a slippage prevention member 48 at a lower part, a frame 4 having an inner part that is formed in accordance to curves of a body; a head rest surface 12 at an upper part of the frame 4 which accommodates a head, a head rest part 10 including head side supports 13 at both sides of the head rest part 10 which are curved inward; an arm rests 20 formed at both lower sides of the head rest part 10; and a height adjusting unit 30 for adjusting height of the chair according to a body size of a child.

Since the cited invention may support the child's neck and back, it may be possible to conveniently bathe the child using both hands while the child is sitting thereon, and adjust the chair according to the body size of the child by using the height adjusting unit 30.

However, according to the cited invention, since the child's buttock contacts the frame 4 because the child is cleaned while the child is sitting on the chair, urine and feces on the buttock may also stain the frame 4, and thus the child may not be fully cleaned. Also, although the height adjusting unit 30 between the child's legs is provided to prevent the child from slipping, children such as infants that cannot balance oneself may cause too much stress for the children to support the whole body by using the height adjusting unit 30.

DETAILED DESCRIPTION OF THE INVENTIVE CONCEPT

Technical Problem

In order to solve the above problems, the goal of the present invention is to provide a bidet for infants and children, which maintains a clean state by minimizing the amount of urine and feces on a child's buttock from staining a bathing chair, and allows safe cleaning of the child using both hands by comfortably resting the child's back, neck and buttock and thus preventing the child from slipping.

Technical Solution

According to an aspect of the inventive concept, there is provided a bidet for infants and children, the bidet comprising a main body shaped as a chair and comprising a backrest part with a predetermined length; a cradling part forming a predetermined angle with the backrest part; a buttock-cradling part connecting the backrest part and the cradling part and concavely recessed, wherein the main body tilts towards a bathtub and allows the infant or the child to be washed in a laid back state, and a discharge port is formed lengthwise through the buttock-cradling part and allowing impurities are easily discharged through the discharge port.

Advantageous Effects

According to the present invention, a buttock-cradling part is formed concavely so that a child's buttock is conveniently accommodated on a main body, and the main body inclines from a bathtub at a predetermined angle so that the child is prevented from slipping when bathing, thereby ensuring the child's safety.

Also, a discharge port is formed lengthwise through the center of the buttock-cradling part so that the main body is less stained with urine and feces even when a child with urine and feces sits on the buttock-cradling part, and water used to clean the child and impurities may be easily discharged through the discharge port. Therefore, the child, especially, the child's buttock with urine and feces may be easily cleaned.

MODE OF THE INVENTIVE CONCEPT

The present invention provides a bidet for infants and children to ensure a clean state by preventing urine and feces on a child's buttock from staining a bathing chair, and safely clean the child with both hands by comfortably accommodating the child's back, neck, and the buttock and preventing the child from slipping. The bidet includes a main body that is shaped as a chair and includes a backrest part having a predetermined length; a cradling part forming a predetermined angle with the backrest part; a buttock-cradling part that couples the backrest part and the cradling part and is concavely recessed, wherein the main body is inclined on a bathtub so that the child may be cleaned in a laid back state, a discharge port is formed lengthwise through the center of the buttock-cradling part so that washed impurities are easily discharged through the discharge port.

The scope of the present invention is not limited to the embodiments described below. Various modifications and adaptations will be readily apparent to those skilled in this art without departing from the spirit and scope of the present inventive concept.

Hereinafter, the bidet for infants and children according to the present invention will be described with reference to FIGS. 2 to 7.

The bidet for infants and children is largely formed of a main body A that is shaped as a chair and includes a backrest part 100, a cradling part 200, and a buttock-cradling part 300 that connects the backrest part 100 and the cradling part 200. The parts may be integrally formed and constitute the main body A, or be separately formed and coupled to constitute the main body A. Also, since the present invention is used when bathing a child, the main body A may be formed of, but is not limited to, a waterproof material. Hereinafter, a portion of the main body A where the child sits and directly contacts is referred to as 'inside,' and the opposite is referred to as 'outside.'

Figure 1:
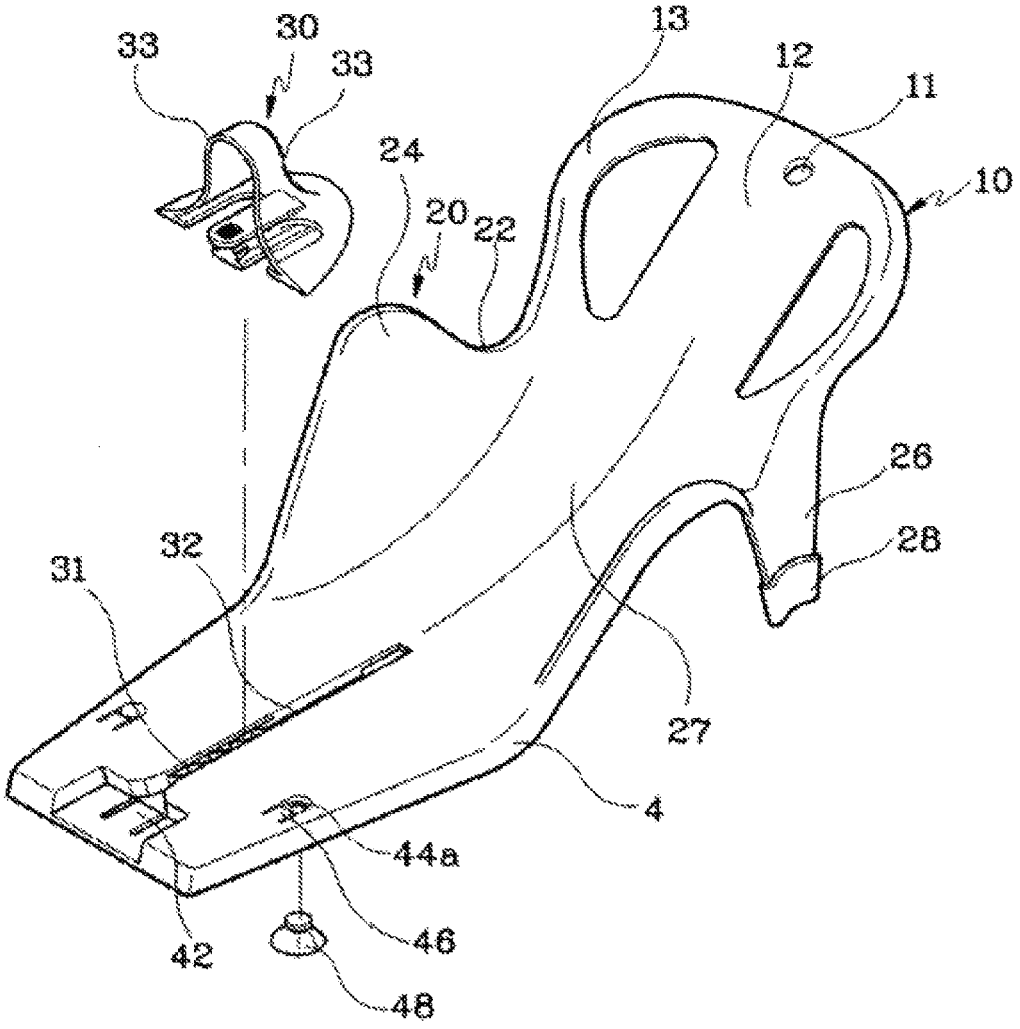
FIG. 1 is a perspective view of a bathing chair for infants, according to the related art.
Figure 2:
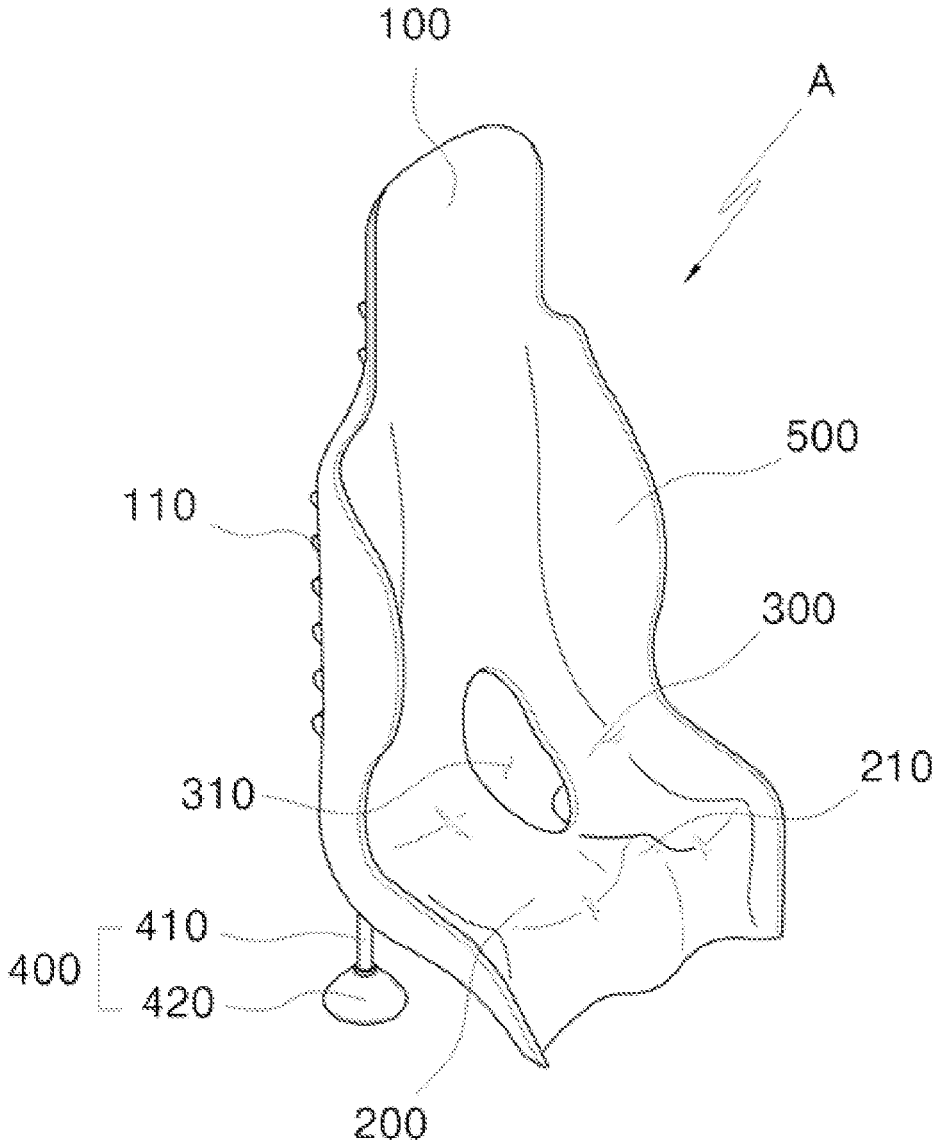
FIG. 2 is a perspective view of a bidet for infants and children, according to the present invention.

As shown in FIG. 2, both sides of the main body A may include wings 500 that extend from the main body A and curved toward the inside. In this case, the main body A is concave overall. Therefore, the child is cradled by the main body A, thereby improving convenience and safety.

The main body A includes, as described above, the backrest part 100, the cradling part 200, and the buttock-cradling part 300, and curved degree and height may be changed according to locations. For example, the wings 500 that extend from the backrest part 100 may be curved such that the wings 500 form an obtuse angle with respect to the backrest part 100 so as to allow the child to easily sit on the main body A and easily raise the child after bathing.

As another example, the wings 500 extending from the buttock-cradling part 300 may be formed such that their height is lower than the wings 500 extending from the backrest part 100. When a discharge port 310, which will be described below, is covered by the child's buttock, the height of the wings 500 extending from the buttock-cradling part 300 is raised such that a certain amount of water is easily discharged. Accordingly, it is possible to prevent other body parts of the child from being infected due to water that is polluted by washing the child's buttock.

Figure 3:
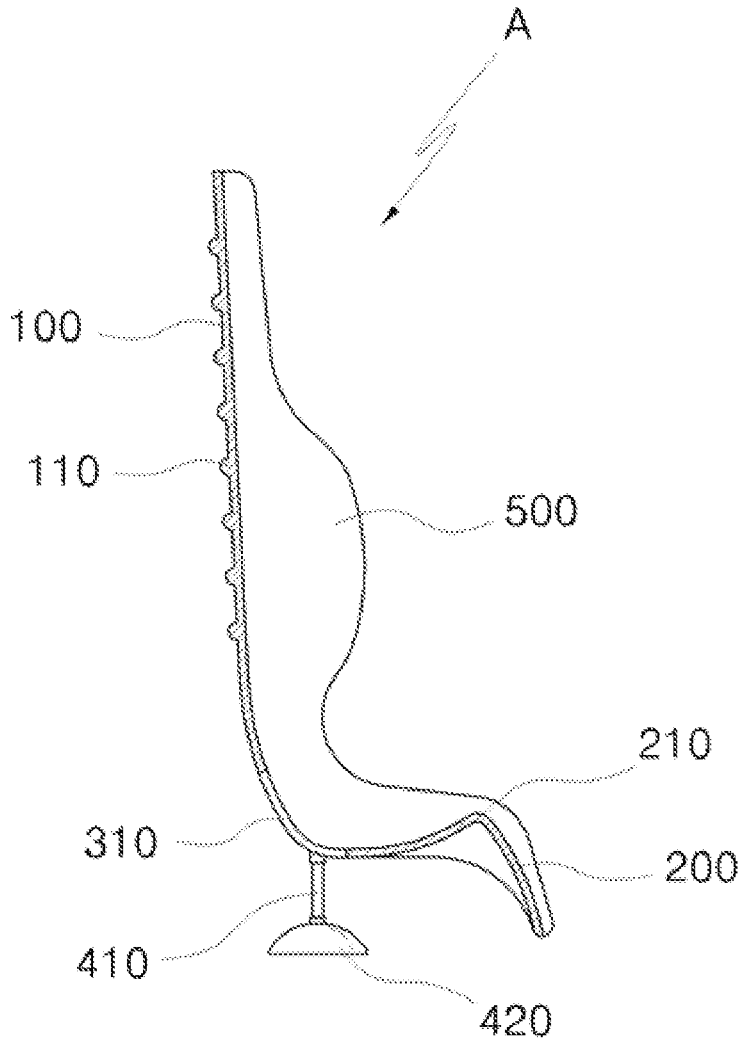
FIG. 3 is a cross-sectional view of a bidet for infants and children, according to the present invention.

The backrest part 100 may be shaped as a plate having a predetermined length as shown in FIGS. 2 and 3, and may support the child's back and head. An inner area of the backrest part 100 may be curved in accordance to the body of the child so that the child is comfortable when sitting on the bidet.

Figure 4:
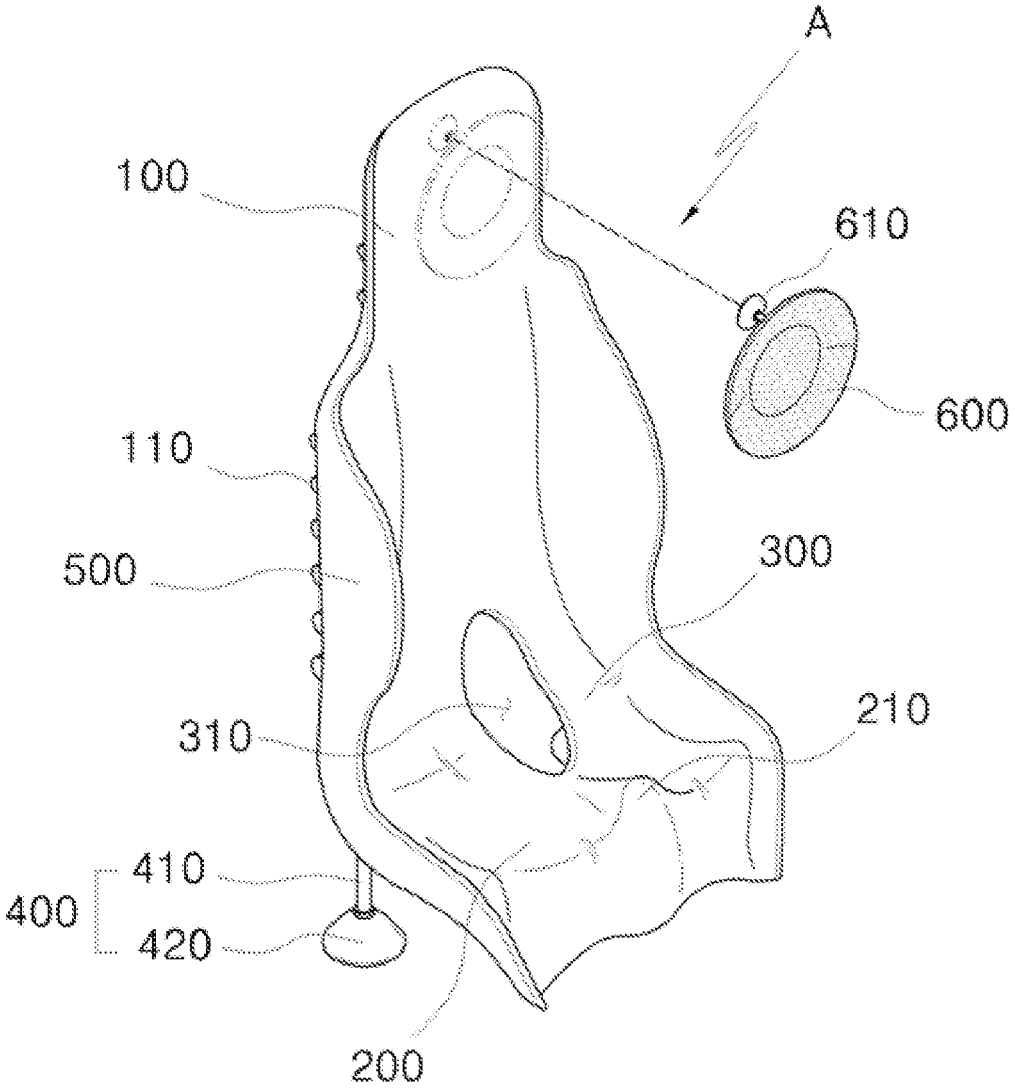
FIG. 4 is a perspective view of a head pad being coupled to a bidet for infants and children, according to the present invention.

An upper inner area of the backrest part 100 may include a head pad 600 that is concave as shown in FIG. 4. The head pad 600 may be concavely formed so that the child's head and neck is comfortably cradled and provide pleasantness when bathing. The head pad 600 may be circle-shaped as shown in FIG. 4, but is not limited thereto and may have various shapes. Also, the head pad 600 may have different degree of concaveness to surround the child's head and support the child's neck.

Furthermore, the head pad 600 may be attached to and detached from the backrest part 100 so that a location of the head pad 600 may be changed according to the child's growth. The head pad 600 may be attached and detached in various ways. As shown in FIG. 4, by providing an adhesive plate 610 formed with a rubber material on the back of the head pad 600, the head pad 600 may be not only easily attachable and detachable, but also be waterproof and not easily detached while bathing. Also, one or more adhesive plates 610 may be provided. As shown in FIG. 4, a location and the number of adhesive plates 610 may be adjusted to change the height of the head pad 600 according to the child.

Figure 5:
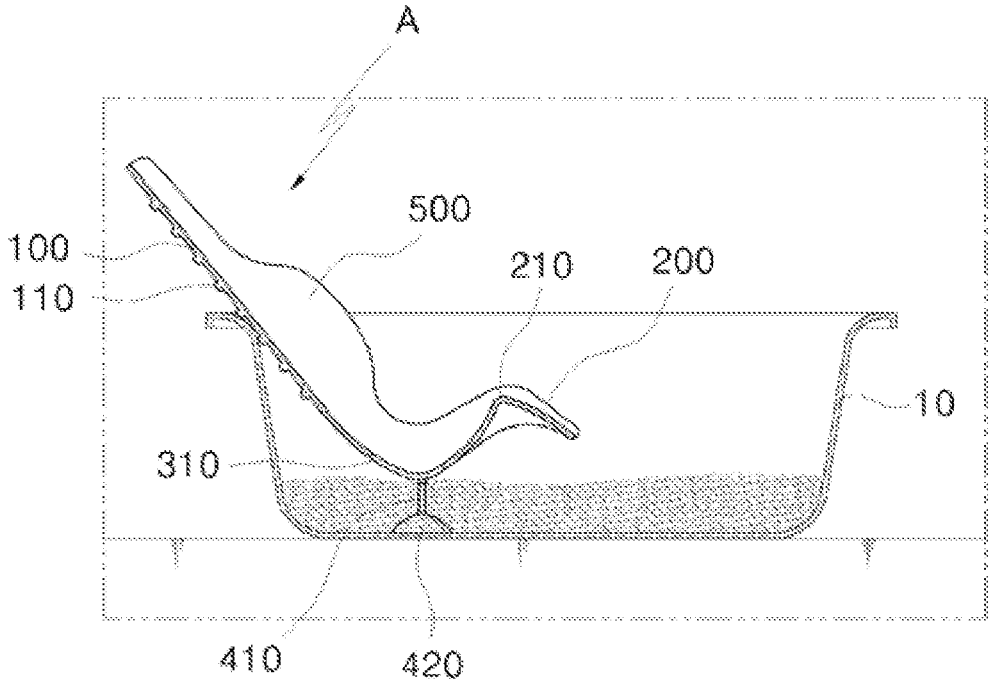
FIG. 5 is an exemplary diagram of a bidet for infants and children provided in a bathtub, according to the present invention.

The bidet for infants and children according to the present invention may be provided in a bathtub 10, a large basin, or a bathroom floor. Hereinafter, it will be assumed that the bidet is provided in the bathtub 10 as shown in FIG. 5. An external surface of the backrest part 100 contacts and rested on the bathtub 10 such that the main body A is inclined. Accordingly, the child may be sitting or lying down depending on a part to be washed, thereby improving convenience while bathing.

Also, as shown in FIGS. 2 to 5, an outwardly protruding hang protrusion 110 is formed at an outer surface of the backrest part 100. Accordingly, when the main body A is inclined, the hang protrusion 110 may be rested over an upper end of the bathtub 10 so as to fix the main body A in an inclined state. In addition, a plurality of hang protrusions 110 may be formed and arranged with predetermined intervals so that the main body A may be safely supported by the bathtub 10 even when the main body A is inclined at various angles.

Therefore, an inclination angle of the main body A may be adjusted to easily allow the child to sit or lie down. In particular, by forming the hang protrusions 110 on an upper outer surface of the backrest part 100, as shown in FIG. 7, the child may be lying down and the child's legs may be raised to conveniently clean the buttock with urine and feces. This will be described below with the buttock-cradling part 300.

The cradling part 200 is formed as a plate that forms a predetermined angle with respect to the backrest part 100 so as to support a lower half of the child. The predetermined angle refers to a right angle or an obtuse angle. Also, the cradling part 200 may be shaped as the letter 'L' as shown in FIGS. 2 and 3, and thus, thighs and calves of the child may contact the cradling part 200.

The cradling part 200 may be sloped upward from a part coupled to the buttock-cradling part 300 to a bent part so that used water flows to the buttock-cradling part 300. Also, the cradling part 200 may be formed such that the bent part and a part cradling the lower body are concavely recessed so that the lower body of the child closely contacts the cradling part 200.

Figure 6:
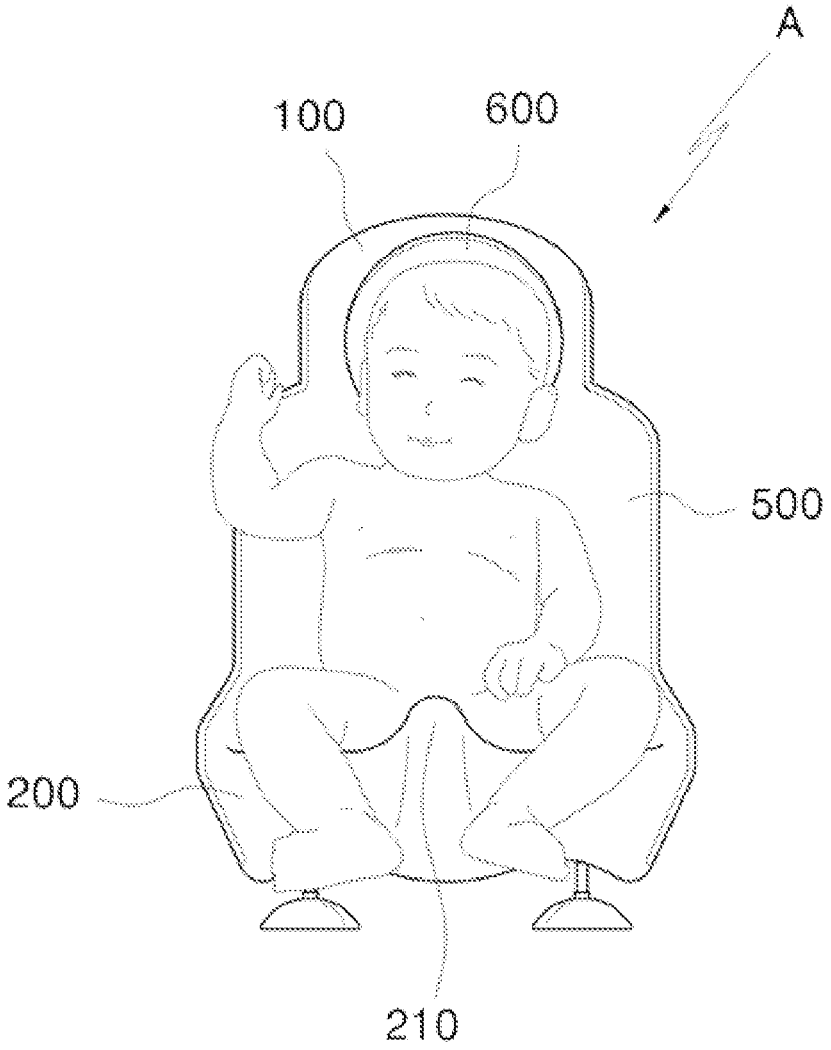
FIG. 6 is an exemplary diagram of a child sitting on a bidet for infants and children, according to the present invention.

As shown in FIGS. 2 and 3, a slippage prevention protrusion 210 may be formed lengthwise in the center of the cradling part 200 and protrude upward. The child's crotch may be placed over the slippage prevention protrusion 210, and thus, the slippage prevention protrusion 210 may prevent the child from slipping when the child is sitting thereon. Also, as shown in FIG. 6, both legs of the child may be naturally separated which allows easy cleaning of various parts of the lower body.

As shown in FIGS. 2 and 3, the buttock-cradling part 300 connects the backrest part 100 and the cradling part 200, and is concavely recessed such that the child's buttock is comfortably cradled on the main body A. Also, as shown in FIG.

2, the discharge port 310 is formed lengthwise through the center of the buttock-cradling part 300.

The discharge port 310 has a horizontal width that is long enough to place a hipbone of the child therein to prevent the child's buttock from being caught in the discharge port 310. Also, the discharge port 310 may be formed lengthwise with predetermined intervals based on the anus of the sitting child.

That is, since the discharge port 310 is formed as an oval that is long in a longitudinal direction of the buttock-cradling part 300 as shown in FIG. 2, a portion of the child's buttock is placed in the discharge port 310 even when the child with urine and feces sits on the bidet. Therefore, there is a less possibility of urine and feces staining the buttock-cradling part 300, which thus allows the child to be bathed in a clean state. Furthermore, since the buttock-cradling part 300 is concave and includes the discharge port 310 in the center, water used to clean the child and other impurities may be easily discharged through the discharge port 310, thereby preventing water or soap water contaminated by urine and feces from infecting the child again.

Figure 7A:
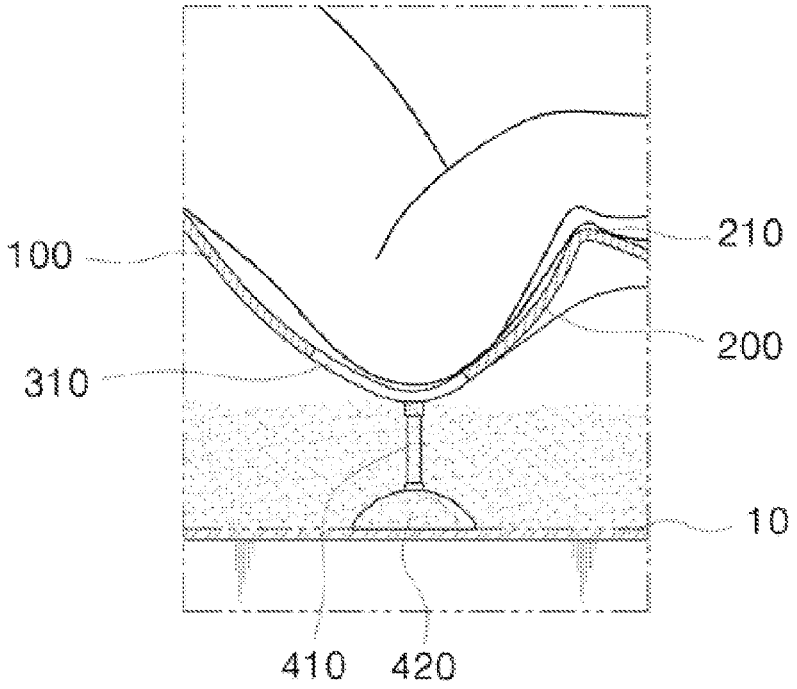
FIGS. 7A and 7B are exemplary diagrams of cleaning a buttock of a child sitting on a bidet for infants and children, according to the present invention.

In particular, in the case of cleaning the buttock with urine and feces, as shown in FIG. 7A, by sprinkling water while the child is sitting, urine and feces on the buttock are discharged through the discharge port 310. Since the child's buttock is partially covering the discharge port 310, a certain amount of water may be gathered in the buttock-cradling part 300 to naturally wash away impurities around the buttock.

Figure 7B:
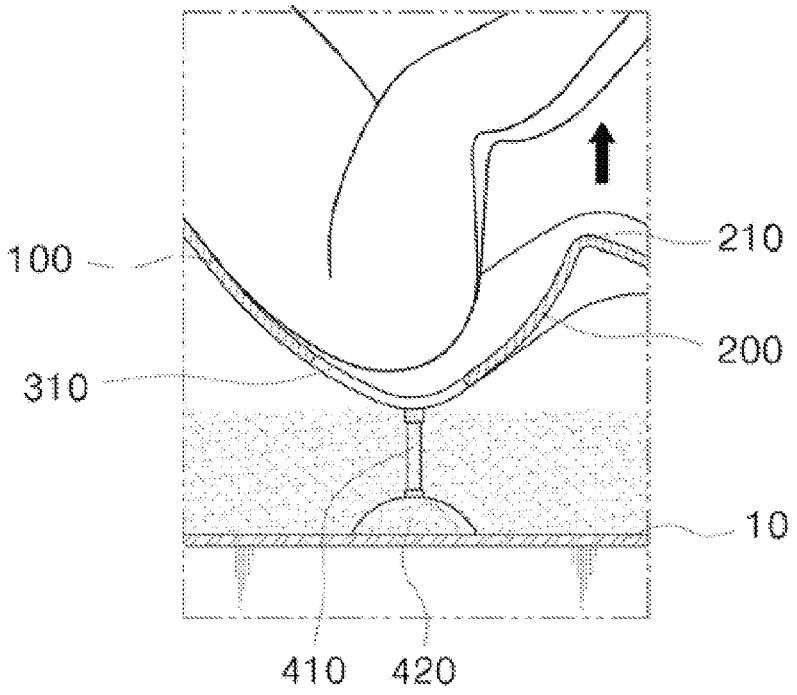

Afterwards, the child's legs may be lifted to completely open the discharge port 310 covered by the buttock and discharge the gathered water, and as the child's buttock is lifted as shown in FIG. 7B, urine and feces left on the buttock may be fully washed away.

Since the bidet for infants and children according to the present invention includes the discharge port 310 through which used water and impurities flow, the bidet has to be installed at a certain height from the bathtub 10. Therefore, as shown in FIGS. 1 to 7, a supporting member 400 with a predetermined length is formed at a bottom surface of the buttock-cradling part 300 so as to support and fix the main body A to a certain height from the bathtub 10, thereby preventing used water and impurities from reaching the child again. At least one supporting member 400 is formed at the bottom surface of the buttock-cradling part 300, and symmetrically formed at both sides of the bottom surface of the buttock-cradling part 300 so that the main body A is balanced.

The supporting member 400 may be formed in various ways and fixed on a bottom surface of the bathtub 10. For example, the supporting member 400 may include a supporting pole 410 having one end coupled to the main body A, and an adhesion plate 420 at another end of the supporting pole 410. The supporting pole 410 is hinge coupled to the main body A, and supports the main body A even when the main body A is inclined. Also, the adhesion plate 420 may be formed of a rubber material as the adhesive plate 610 formed on the head pad 600 so that the adhesion plate 420 may be easily attached to and detached from the bathtub 10, be waterproof, and not easily detachable when bathing.

As described above, in the bidet for infants and children according to the present invention, the buttock-cradling part 300 is concavely formed to allow the child's buttock to be comfortably cradled on the main body A, the main body A may be installed at a certain height from the bathtub 10 and inclined at a predetermined angle so as to prevent the child from slipping when bathing thereby ensuring safety of the child, and prevent used water or impurities from infecting the child again.

Also, the discharge port 310 is formed lengthwise through the center of buttock-cradling part 300 so that the main body is less stained with urine and feces even when a child with urine and feces sits on the buttock-cradling part 300, and water used to clean the child or impurities may be easily discharged through the discharge port 310. Therefore, the child, especially, the child's buttock with urine and feces may be easily cleaned.

The invention claimed is:

1. A bidet for infants and children, the bidet comprising:

a main body that is shaped as a chair, has an inner surface and an outer surface and comprises a backrest part with a predetermined length, a cradling part forming a predetermined angle with the backrest part, and a buttock-cradling part between the backrest part and the cradling part and connecting the backrest part and the cradling part and concavely recessed in the inner surface of the main body;

a plurality of hang protrusions formed at an outer surface of the backrest part and arranged with predetermined intervals for fixing the main body at different angles such that when the main body tilts towards a bathtub, a hang protrusion of the plurality of hang protrusions is supported by an upper part of the bathtub, at an inclined state to allow an infant or a child to be washed in a laid back state, the number of the plurality of hang protrusions being 3 or more than 3, and a supporting member having a predetermined length and formed at a bottom surface of the buttock-cradling part such that the main body is fixed at a certain height form a bottom surface of the bathtub when the main body tilts towards the bathtub, wherein a discharge port is formed lengthwise through a center portion of the buttock-cradling part concavely recessed in the inner surface of the main body to allow impurities to be discharged through the discharge port.

2. The bidet of claim 1, wherein the supporting member comprises a supporting pole that is hinge coupled to the main body, and an adhesive plate that is formed at another end of the supporting pole.

3. The bidet of claim 1, further comprising a slippage prevention protrusion at a center of the cradling part and protruding upward in a longitudinal direction, and a crotch area of the infant or the child is placed over the slippage prevention protrusion.

4. The bidet of claim 1, further comprising wings at both sides of the main body, the wings extending from the main body and inwardly curved, so as to prevent the infant or the child from departing from the main body.

5. The bidet of claim 4, wherein portions of the wings extending from the buttock-cradling part are lower than portions of the wings extending from the backrest part.

6. The bidet of claim 1, further comprising a concave head pad at an upper inner area of the backrest part, and an adhesive plate at a back surface of the head pad such that the head pad is attachable to and detachable from the backrest part.

7. The bidet of claim 1, wherein the backrest part, the cradling part and the buttock-cradling part are integrally formed to constitute the main body.

8. The bidet of claim 1, wherein the backrest part, the cradling part and the buttock-cradling part are separately formed and coupled to constitute the main body.

* * * * *